US006234883B1

(12) United States Patent
Berman et al.

(10) Patent No.: US 6,234,883 B1
(45) Date of Patent: May 22, 2001

(54) METHOD AND APPARATUS FOR CONCURRENT PAD CONDITIONING AND WAFER BUFF IN CHEMICAL MECHANICAL POLISHING

(75) Inventors: Michael J. Berman, West Linn, OR (US); Karey L. Holland, Phoenix, AZ (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 08/942,006

(22) Filed: Oct. 1, 1997

(51) Int. Cl.[7] ..... B24B 29/00
(52) U.S. Cl. ..... 451/286; 451/443
(58) Field of Search ..... 451/57, 65, 56, 451/285, 286, 287, 288, 290, 443, 444

(56) References Cited

U.S. PATENT DOCUMENTS

| | | |
|---|---|---|
| 4,793,895 | 12/1988 | Kaanta et al. . |
| 5,036,015 | 7/1991 | Sandhu et al. . |
| 5,081,051 | 1/1992 | Mattingly et al. . |
| 5,081,421 | 1/1992 | Miller et al. . |
| 5,144,711 | 9/1992 | Gill, Jr. . |
| 5,151,584 | 9/1992 | Ebbing et al. . |
| 5,169,491 | 12/1992 | Doan . |
| 5,196,353 | 3/1993 | Sandhu et al. . |
| 5,216,843 | 6/1993 | Breivogel et al. . |
| 5,222,329 | 6/1993 | Yu . |
| 5,240,552 | 8/1993 | Yu et al. . |
| 5,245,790 | 9/1993 | Jerbic . |
| 5,245,794 | 9/1993 | Salugsugan . |
| 5,257,478 | 11/1993 | Hyde et al. . |
| 5,265,378 | 11/1993 | Rostoker . |
| 5,272,115 | 12/1993 | Sato . |
| 5,308,438 | 5/1994 | Cote et al. . |
| 5,310,455 | 5/1994 | Pasch et al. . |
| 5,321,304 | 6/1994 | Rostoker . |
| 5,337,015 | 8/1994 | Lustig et al. . |
| 5,389,194 | 2/1995 | Rostoker et al. . |
| 5,399,234 | 3/1995 | Yu et al. . |

(List continued on next page.)

OTHER PUBLICATIONS

"Avant Gaard 676", IPEC–Planar Bulletin #4500–104621, 1997.

"Avant Gaard 776", IPEC–Planar Bulletin #4500–104660, 1997.

*Primary Examiner*—Joseph J. Hail, III
*Assistant Examiner*—Dung Van Nguyen
(74) *Attorney, Agent, or Firm*—Beyer Weaver & Thomas, LLP

(57) ABSTRACT

Provided are an apparatus and method for concurrently pad conditioning and wafer buffing on a single station of a CMP apparatus. In a preferred embodiment, the apparatus includes a two-sided conditioning/buffing device having a pad conditioner on one side and a buff pad on the other. In operation, the device is inserted between a polishing pad and a polished wafer following CMP. A differential velocity is developed between the pad conditioner and the polishing pad, for example, by contacting the pad conditioner with a rotating or orbiting polishing pad. Concurrently, the polished wafer is contacted with the buff pad on the other side of the device, and a differential velocity is developed between the two, for example, by rotating the wafer, so that the wafer is buffed. Once conditioning and buffing are completed, the finished wafer is removed from the buffing pad and stored or removed from the CMP apparatus, and the conditioning/buffing device is removed and positioned away from the polishing pad, which is now ready to receive and polish another wafer. This concurrent conditioning and buffing allows all stations on a CMP apparatus to be used for polishing, and improves the through-put of the apparatus.

14 Claims, 6 Drawing Sheets

U.S. PATENT DOCUMENTS 5,403,228 4/1995 Pasch .
5,405,806 4/1995 Pfeister et al. .
5,439,551 8/1995 Meikle et al. .
5,483,568 1/1996 Yano et al. .
5,492,594 2/1996 Burke et al. .
5,516,400 5/1996 Pasch et al. .
5,531,861 7/1996 Yu et al. .
5,536,202 7/1996 Appel, et al. .
5,547,417 8/1996 Breivogel et al. .
5,554,065 * 9/1996 Kirchner et al. ..... 156/345
5,559,428 9/1996 Li et al. .
5,561,541 10/1996 Sharp et al. .
5,595,526 1/1997 Yau et al. .
5,597,442 1/1997 Chen et al. .
5,609,511 3/1997 Moriyama et al. .
5,611,943 * 3/1997 Cadien et al. ..... 216/88
5,624,304 4/1997 Pasch et al. .
5,626,715 5/1997 Rostoker .
5,637,185 6/1997 Murarka et al. .
5,639,388 6/1997 Kimura et al. .
5,643,046 7/1997 Katakabe et al. .
5,643,050 7/1997 Chen .
5,644,221 7/1997 Li et al. .
5,647,952 7/1997 Chen .
5,658,183 8/1997 Sandhu et al. .
5,660,672 8/1997 Li et al. .
5,663,797 9/1997 Sandhu .
5,664,987 9/1997 Renteln .
5,667,424 9/1997 Pan .
5,667,433 9/1997 Mallon .
5,667,629 9/1997 Pan et al. .
5,668,063 9/1997 Fry et al. .
5,670,410 9/1997 Pan .
5,672,091 9/1997 Takahashi et al. .
5,674,784 10/1997 Jang et al. .
5,695,660 12/1997 Litvak .
5,700,180 12/1997 Sandhu et al. .
5,705,435 1/1998 Chen .
5,710,076 1/1998 Dai et al. .
5,712,185 1/1998 Tsai et al. .
5,722,875 3/1998 Iwashita et al. .
5,741,171 4/1998 Sarfaty et al. .
5,777,739 7/1998 Sandhu et al. .
5,785,585 * 7/1998 Manfredi et al. ..... 451/288
5,861,055 1/1999 Allman et al. .
5,865,666 2/1999 Nagahara .
5,868,608 2/1999 Allman et al. .
5,882,120 3/1999 Berman et al. .
5,888,120 3/1999 Doran .
5,893,756 4/1999 Berman et al. .
5,931,719 8/1999 Nagahara et al. .
5,948,697 9/1999 Hata .
5,957,757 9/1999 Berman .
5,990,010 * 11/1999 Berman ..... 438/691
6,093,280 * 7/2000 Kirchner et al. ..... 156/345

* cited by examiner

METHOD AND APPARATUS FOR CONCURRENT PAD CONDITIONING AND WAFER BUFF IN CHEMICAL MECHANICAL POLISHING

BACKGROUND OF THE INVENTION

The present invention relates to conditioning of a polishing pad employed in chemical mechanical polishing (CMP). More particularly, the present invention relates to an apparatus and method for concurrent pad conditioning and wafer buffing in a CMP tool.

Chemical mechanical polishing (sometimes referred to as "CMP") typically involves mounting a semiconductor wafer on a holder and rotating the wafer face against a polishing pad mounted on a platen, which in turn is rotating or moving linearly or orbitally. A slurry containing a chemical that chemically interacts with the facing wafer layer and an abrasive that physically removes that layer is flowed between the wafer and the polishing pad or on the pad near the wafer. In integrated circuit (IC) wafer fabrication, this technique is commonly applied to planarize various wafer layers such as dielectric layers, metallization layers, etc.

FIG. 1 shows some major components of a chemical mechanical polishing (CMP) apparatus. Examples of such apparatuses include the AvantGaard 676 or 776, commercially available from Integrated Processing Equipment Corporation (IPEC) of Phoenix, Arizona, and described in IPEC Bulletins #4500-104621 and #4500-104660 (1997), which are incorporated herein by reference for all purposes. CMP apparatus 100 includes a wafer carrier 128 that is fitted with an air chamber 126 (shown in phantom lines), which is designed to secure a wafer 124 by vacuum to wafer carrier 128 during wafer loading typically before CMP is to commence. During CMP, however, wafer 124 is bound by "wear rings" (not shown to simplify illustration) within wafer carrier 128 such that a wafer surface that is to be polished contacts a polishing pad 102. During CMP, the polishing pad 102 orbits while the wafer 124 rotates.

A conventional polishing pad 102 for use with an apparatus such as illustrated in FIG. 1 includes a plurality of slurry injection holes 120, and adheres to a flexible pad backing 104 which includes a plurality of pad backing holes 118 aligned with the slurry injection holes 120. A slurry mesh 106, typically in the form of a screen-like structure, is positioned below the pad backing 104. An air bladder 108 capable of inflating or deflating is disposed between a plumbing reservoir 110 and the slurry mesh 106. The air bladder 108 pressurizes to apply the polishing force. A co-axial shaft 112, through which a slurry inlet 114 (shown by phantom lines) is provided to deliver slurry through the plumbing reservoir 110 and the air bladder 108 to the slurry mesh 106, is attached to the bottom of plumbing reservoir 110. Slurry is delivered to the system by an external low pressure pump, and is distributed on the polishing pad surface by centripetal force, the polishing action, and slurry pressure distribution on the pad 102. The polishing pad 102 may also be provided with grooves or perforations (not shown) for slurry distribution and improved pad-wafer contact.

Unfortunately after polishing on the same polishing pad over a period of time, the polishing pad suffers from "pad glazing." As is well known in the art, pad glazing results when the particles eroded from the wafer surface along with the abrasives in the slurry tend to glaze or accumulate over the polishing pad. A glazed layer on the polishing pad typically forms atop eroded wafer and slurry particles that are embedded in the porosity or fibers of the polishing pad. Pad glazing is particularly pronounced during planarization of an oxide layer such as silicon dioxide layer (hereinafter referred to as "oxide CMP"). By way of example, during oxide CMP, eroded silicon dioxide particulate residue accumulates along with the abrasive particles from the slurry to form a glaze on the polishing pad. Pad glazing is undesirable because it reduces the polishing rate of the wafer surface and produces a non-uniformly polished wafer surface. The non-uniformity results because glazed layers are often unevenly distributed over a polishing pad surface.

One way of achieving and maintaining a high and stable polishing rate is by conditioning the polishing pad (the process of conditioning a polishing pad is hereinafter referred to as "pad conditioning") on a regular basis, e.g., either every time after a wafer has been polished or simultaneously during wafer CMP. During pad conditioning, a conditioning arm or an abrasive disk is typically contacted with a polishing pad, which may be rotating or in an orbital state.

FIG. 2A shows a top view of some significant components of a conditioning sub-assembly 200, which may be integrated into a CMP apparatus such as the IPEC 676. Conditioning sub-assembly 200 includes a polishing pad 202 and a conditioning arm 204 that is disposed above polishing pad 202 and capable of pivoting about a pivoting point 206. Conditioning arm 204, as shown in FIG. 2A, is typically longer in length than a diameter of the polishing pad. For illustration purposes, FIG. 2B shows a bottom view of conditioning arm 204 of FIG. 2A. The bottom surface of conditioning arm 204 includes a plurality of diamond abrasive particles 208, which are substantially uniformly arranged on the conditioning arm such that if conditioning arm 204 contacts polishing pad 202, abrasive particles 208 engage with a substantial portion of the polishing pad.

Before conditioning sub-assembly 200 of FIG. 2A begins conditioning of polishing pad 202, conditioning arm 204 is lowered automatically to contact a polishing pad 202, which may be rotating or in orbital state. A pneumatic cylinder (not shown to simplify illustration) may then apply a downward force on conditioning arm 204 such that abrasive particles 208 contact and engage with a substantial portion of polishing pad 202. During pad conditioning, conditioning arm 204 pivots on pivoting end 206 and sweeps back and forth across polishing pad 202 like a "windshield wiper blade" from a first position 204' (shown by dashed lines) at one end of the polishing pad to a second position 204Δ (shown by dashed lines) at the other end of the polishing pad. This mechanical action of conditioning arm 204 allows abrasive particles 208 to break up and remove the glazed or accumulated particles coated on the polishing pad surface.

At the conclusion of some CMP procedures, a fine polishing, also referred to as buffing, is often performed on the wafer in order to produce the smoothest possible wafer surface. Buffing typically uses a relatively soft pad formed, for example, from polyurethane impregnated felt. An example is the Polytex™ pad available from Rodel Corp. of Newark, Del. Buffing also typically uses deionised water or may be assisted by a conventional oxide slurry.

Unfortunately, currently used pad conditioning and wafer buffing systems reduce the efficiency of CMP operations. FIG. 3 is a simplified top view of a typical multi-station CMP apparatus, such as the IPEC 676 or 776, described previously. The CMP apparatus 300 has four polishing stations 302, 304, 306 and 308, each with a polishing pad 310 and the other associated features described with reference to FIG. 1 (not shown in this view to simplify illustration). As shown in FIG. 3, the apparatus 300 also includes two conditioning sub-assemblies 320 and 322, such as described with reference to FIGS. 2A and 2B, each of which service two polishing stations. For example, as shown in FIG. 3, conditioning sub-assembly 320 services polishing stations 302 and 304. Each conditioning sub-assembly 320 includes a conditioning arm 324 that may be swung out above a polishing pad polishing pad 202 by pivoting about a pivoting point 326.

With conventional CMP techniques, one of the four stations on the CMP apparatus is typically dedicated to buffing, or a separate buffing station must be provided in addition to the polishing stations. This reduces the number of polishing stations available on the apparatus, or requires that the wafer be moved to a separate buffing station for buffing, both of which result in a significant reduction in the through-put capacity of the machine. Moreover, since a polishing pad must be conditioned following each wafer polishing, that pad is unavailable to receive another wafer for polishing until conditioning is complete. This is a further impediment to CMP efficiency.

Therefore, an improved apparatus and process for pad conditioning and wafer buffing that improves the efficiency of the CMP process would be desirable.

SUMMARY OF THE INVENTION

To achieve the foregoing, the present invention provides an apparatus and method for concurrently pad conditioning and wafer buffing on a single station of a CMP apparatus. In a preferred embodiment, the apparatus includes a two-sided conditioning/buffing device having a pad conditioner on one side and a buff pad on the other. In operation, the device is inserted between a polishing pad and a polished wafer following CMP. A differential velocity is developed between the pad conditioner and the polishing pad, for example, by contacting the pad conditioner with a rotating or orbiting polishing pad. Concurrently, the polished wafer is contacted with the buff pad on the other side of the device, and a differential velocity is developed between the two, for example, by rotating the wafer, so that the wafer is buffed. Once conditioning and buffing are completed, the finished wafer is removed from the buffing pad and stored or removed from the CMP apparatus, and the conditioning/buffing device is removed and positioned away from the polishing pad, which is now ready to receive and polish another wafer. This concurrent conditioning and buffing allows all stations on a CMP apparatus to be used for polishing, and improves the through-put of the apparatus.

The invention provides a device for concurrently pad conditioning and wafer buffing at a single station on a chemical mechanical polishing apparatus. The device includes a positioning mechanism for positioning the device within the apparatus, and a body connected to one end of the positioning mechanism. The body has a buffing pad on one of its upper or lower surfaces and a pad conditioner on the other surface. The body may also contain one or more transport lines for conditioning and/or buffing supplies.

The invention also provides a chemical mechanical polishing apparatus. The apparatus includes a wafer carrier, one or more polishing pads, each polishing pad at a polishing station, and one or more devices for concurrently pad conditioning and wafer buffing at a single station on a chemical mechanical polishing apparatus. Each device includes a positioning mechanism for positioning the device within the apparatus, and a body connected to one end of the positioning mechanism. The body has a buffing pad on one of its upper or lower surfaces and a pad conditioner on the other surface. The body may also contain one or more transport lines for conditioning and/or buffing supplies.

The invention further provides a chemical mechanical polishing apparatus module. The module includes one or more polishing pads, each polishing pad at a polishing station, and one or more devices for concurrently pad conditioning and wafer buffing at a single station on a chemical mechanical polishing apparatus module. Each device includes a positioning mechanism for positioning the device relative to the module, and a body connected to one end of the positioning mechanism. The body has a buffing pad on one of its upper or lower surfaces and a pad conditioner on the other surface. The device may also contain one or more transport lines for conditioning and/or buffing supplies.

In addition, the invention provides a process for chemical mechanical polishing of a semiconductor wafer. The method involves providing a semiconductor wafer to a chemical mechanical polishing apparatus, polishing the wafer by contacting it with a polishing pad at a station on the apparatus, and concurrently, conditioning the polishing pad and buffing the wafer at the station on the apparatus.

The invention further comprises a process for chemical mechanical polishing of a semiconductor wafer on an apparatus in accordance with the present invention. The method involves providing a semiconductor wafer to a chemical mechanical polishing apparatus and polishing said wafer by contacting it with a polishing pad at a station on said apparatus. The wafer is then removed from the polishing pad, and a device having a pad conditioner on one of its upper or lower sides and a buff pad its other side is positioned between the wafer and the polishing pad. The pad conditioner is contacted with the polishing pad and the wafer is contacted with the buff pad. Then, concurrently, the polishing pad is conditioned and the wafer is buffed.

These and other features and advantages of the present invention are described below with reference to the drawings.

DETAILED DESCRIPTION OF THE PREFERRED EMBODIMENTS

The present invention provides an apparatus and method for concurrently pad conditioning and wafer buffing on a single station of a CMP apparatus. In the following description, numerous specific details are set forth in order to fully illustrate preferred embodiments of the present invention. It will be apparent, however, that the present invention may be practiced without limitation to some specific details presented herein.

Figure 4:
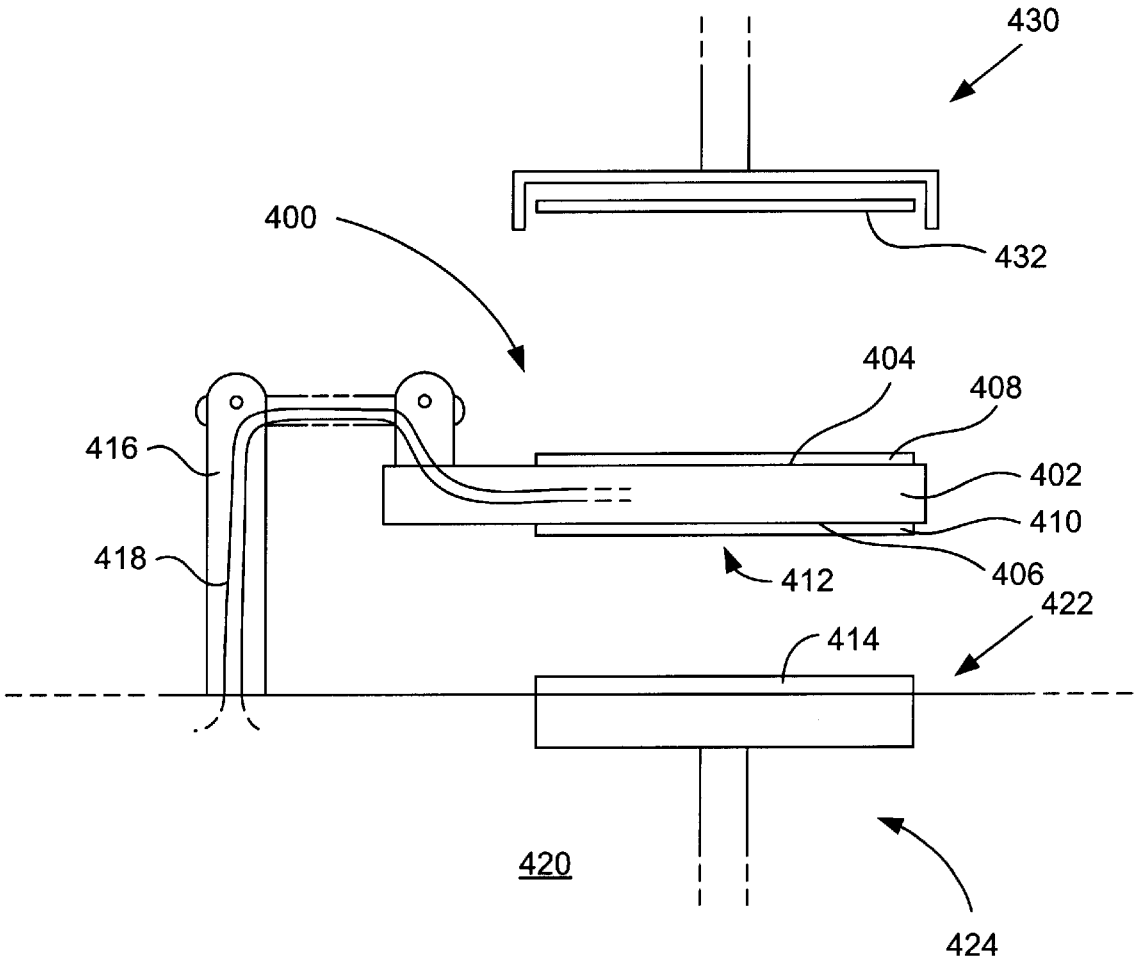
FIG. 4 depicts a cross-sectional view of a conditioning/buffing device integrated with chemical mechanical polishing apparatus according to a preferred embodiment of the present invention.

FIG. 4 shows a cross-sectional view of a conditioning/buffing device according to a preferred embodiment of the present invention, integrated with chemical mechanical polishing apparatus. The device 400 has a body 402 having an upper side 404 and a lower side 406 when the device is deployed in its active position, as shown in FIG. 4. The terms "upper" and "lower" are relative, and may be interchangeable. On its upper side 404, the device 400 has a buffing pad 408, such as the Polytex™ pad described above. The pad 408 will typically contain small holes (not shown) for water and/or buffing slurry to pass through during buffing. The buffing pad 408 may be mounted on the body 402 of the device 400 in conventional ways well known to those of skill in the art. For example, buffing pads may have pressure sensitive adhesive (PSA) backings.

On its lower side 406, the device 400 has a pad conditioner 410, such as a conditioning arm or an abrasive disk coated or impregnated with diamond grit on its surface 412 which faces the polishing pad 414. The pad conditioner 410, like the buffing pad 408, may have a conventional mechanism well known in the art, such as the conditioning sub-assembly described above. The pad conditioner 410 should be mounted on the body 402 of the device 400 so that it contacts the polishing pad 414 when the device 400 is lowered onto a polishing pad 414 for conditioning.

In a preferred embodiment, the device 400 may be integrated with an otherwise conventional CMP apparatus, such as an IPEC 676 or 776. Such an apparatus may be composed of a plurality of modules, for example, an upper module which includes a wafer carrier mechanism, and a lower module which contains one or more polishing stations, and conditioning and buffing mechanisms. In a preferred embodiment, the device 400 is intended to replace conventional conditioning and buffing mechanisms which might otherwise be included on the conventional CMP apparatus or apparatus module. For clarity of illustration, FIG. 4 shows only that portion of a CMP apparatus 420 adjacent to a polishing station 422. The term "apparatus 420" in the description should be understood to also refer to a module of a CMP apparatus where such an apparatus is composed of modules.

The body 402 of the device 400 may be connected by an articulated arm assembly 416 to an otherwise conventional CMP apparatus (or apparatus module) 420, such as an IPEC 676 or 776, at a location adjacent to a polishing station 422. The arm 416 is capable of moving the body 402 of the device 400 into an active position between the wafer 432 and the polishing pad 414 during concurrent conditioning and buffing (as shown in FIG. 4), and into an inactive position, away from the polishing station 422 when the device 400 is not in use. The arm 416 is preferably able to move the body 402 laterally and vertically so that it can oscillate the body and apply the appropriate down force during conditioning/buffing. The arm 416 is also preferably able to rotate the body 402 from its horizontal active position to a vertical position for ease of storage when it is inactive.

In addition, the device 400 preferably includes one or more transport lines 418 for providing water, slurry, air, electricity and other conditioning and buffing needs to the buffing pad 408 and the pad conditioner 410 located on upper and lower surfaces of the body 402, respectively, during concurrent conditioning Ind buffing. As shown in FIG. 4, the lines 418 are routed from the CMP apparatus 420 to the body 402 of the device 400 through the arm 416 connecting the device 400 to the apparatus 420. Of course, the selection and installation of such transport lines 418 are well within the skill of those skilled in the art, and the lines 418 may also be routed differently within the scope of the present invention.

Figure 1:
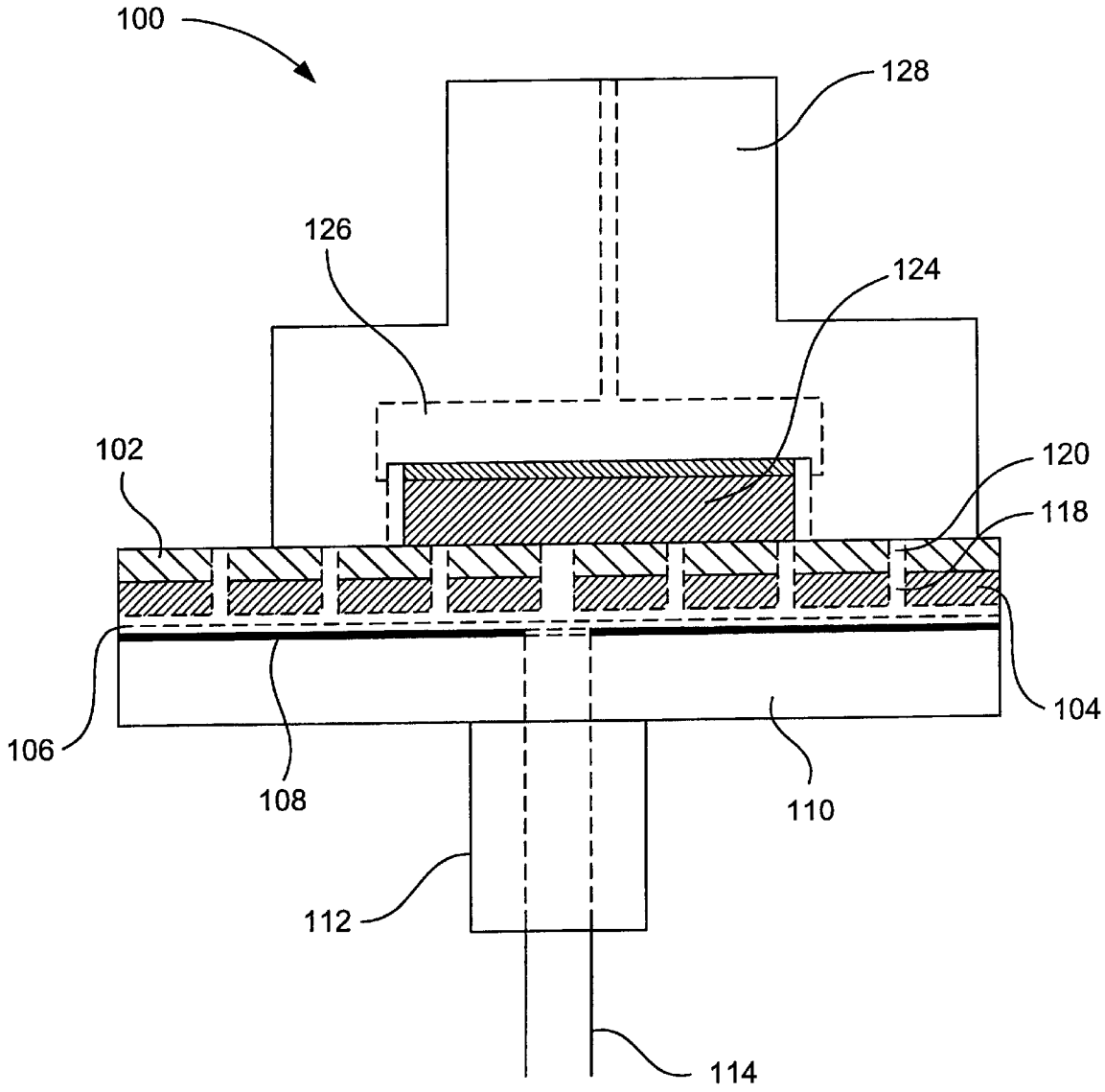
FIGURE 1 (Prior Art)
FIG. 1 depicts a cross-sectional view of a typical chemical mechanical polishing apparatus.
Figure 2A:
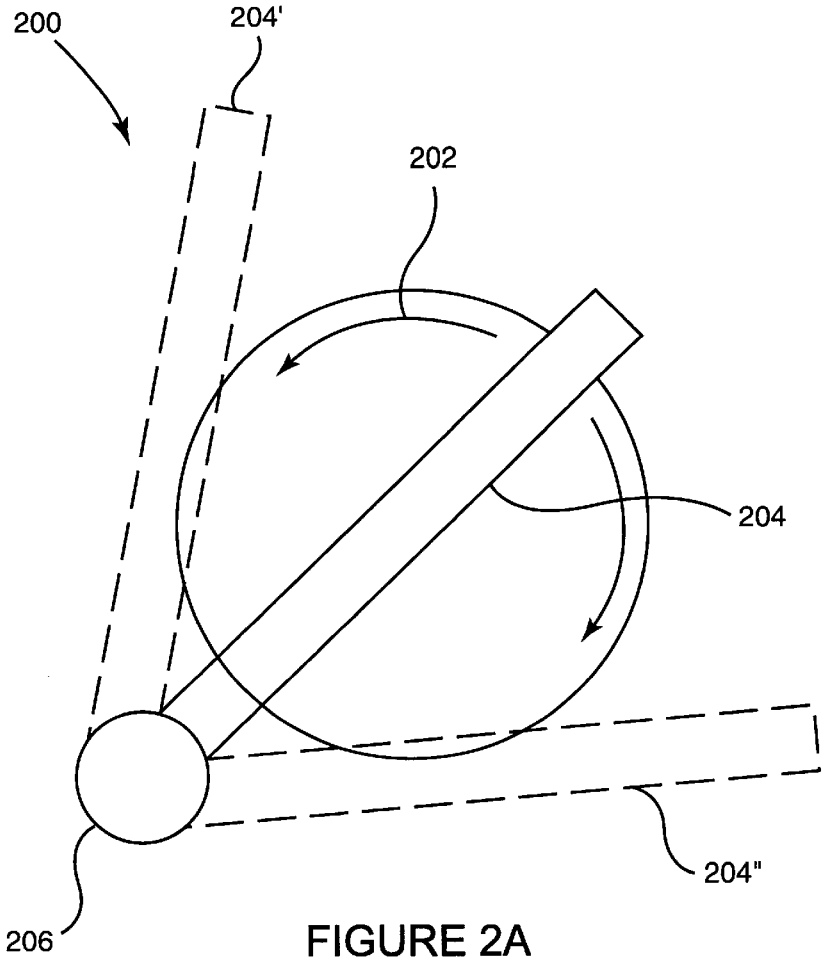
FIGURE 2A (Prior Art)
FIG. 2A depicts a top plan view of a typical pad conditioning sub-assembly for use in chemical mechanical polishing.
Figure 2B:
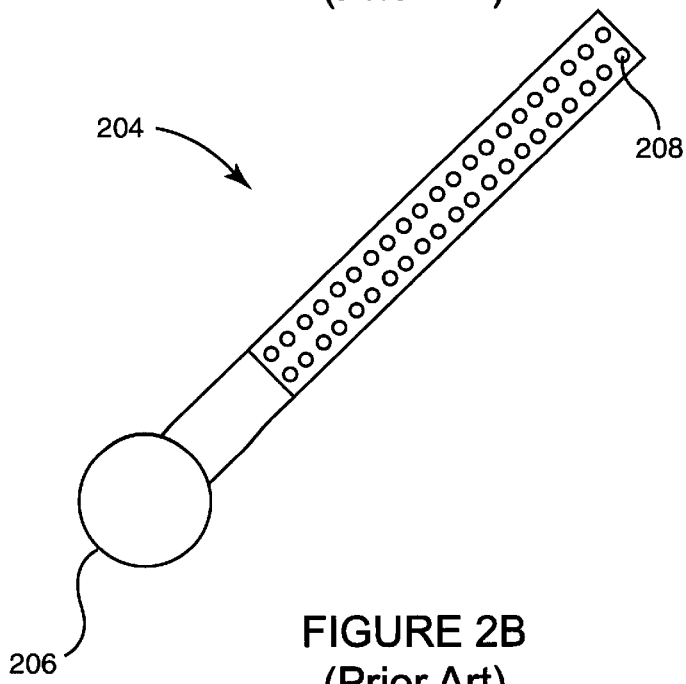
FIGURE 2B (Prior Art)
FIG. 2B depicts a bottom view of the conditioning arm of the sub-assembly of FIG. 2A.
Figure 3:
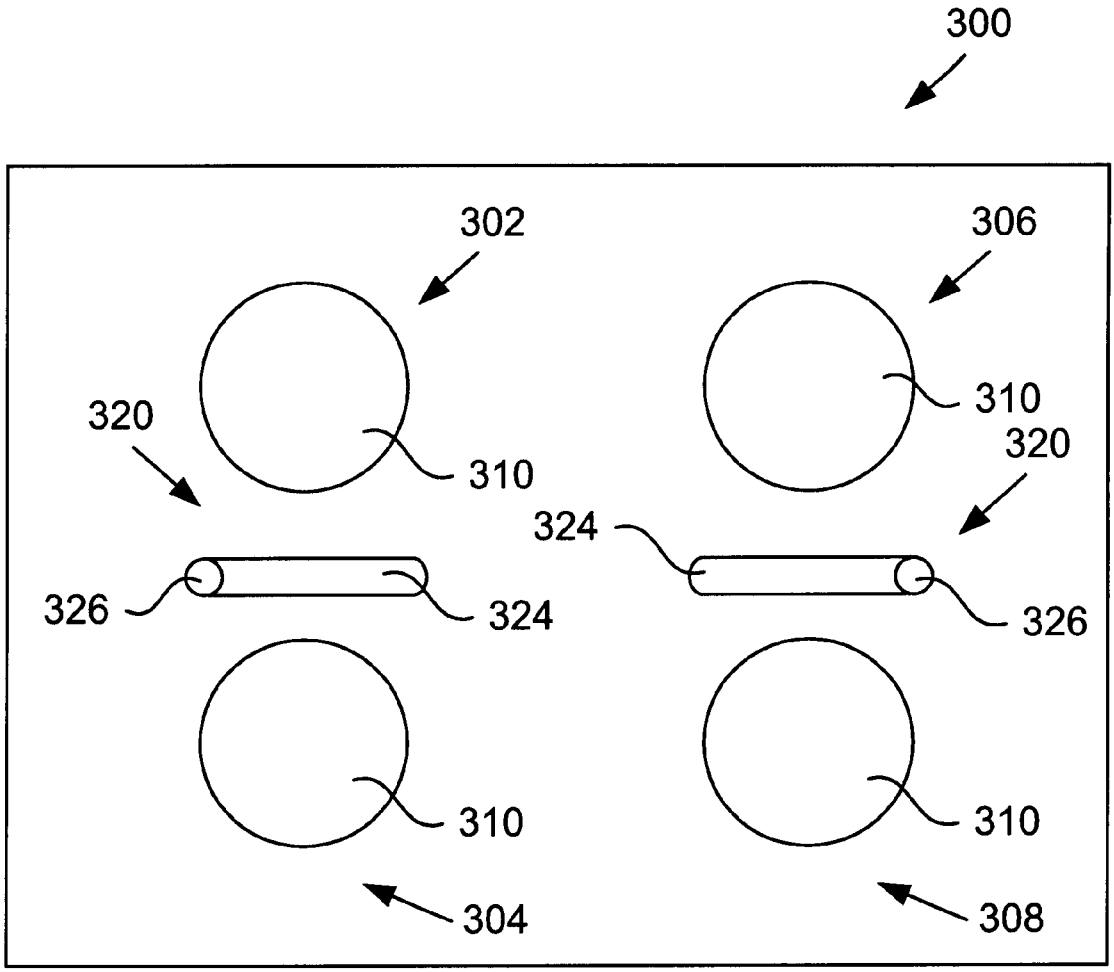
FIGURE 3 (Prior Art)
FIG. 3 depicts a simplified top view of a typical multi-station CMP apparatus.

The device is preferably integrated with an otherwise conventional CMP apparatus 420, such as an IPEC 676 or 776, a portion of which is shown in FIG. 4. The figure shows a portion of one of four polishing stations 422 on the CMP apparatus 420. In the embodiment depicted in FIG. 4, the apparatus 420 includes a conventional chuck mechanism 424 supporting the polishing pad 414 and a conventional wafer carrier mechanism 430, as illustrated described in more detail, for example, in and with reference to FIG. 1. The device 400 and apparatus 420 operate in concert to provide appropriate differential velocity between the polishing pad 414 and the pad conditioner 410, preferably about 30 to 250 feet/minute, and the wafer 432 and the buffing pad 408, preferably about 30 to 80 RPM to accomplish the conditioning and buffing concurrently. The device 400 and apparatus 420 also operate in concert to provide the appropriate down force for both operations, typically about 2–5 psi.

It should also be understood that the device 400 of the present invention may be used to perform joint operations on a single polishing station other than conditioning and buffing. For example, with the use of other pads on the device 400 and the supply of appropriate reagents (e.g. slurry) polishing operations other than buffing may be performed in conjunction with conditioning according to the present invention.

Figure 5:
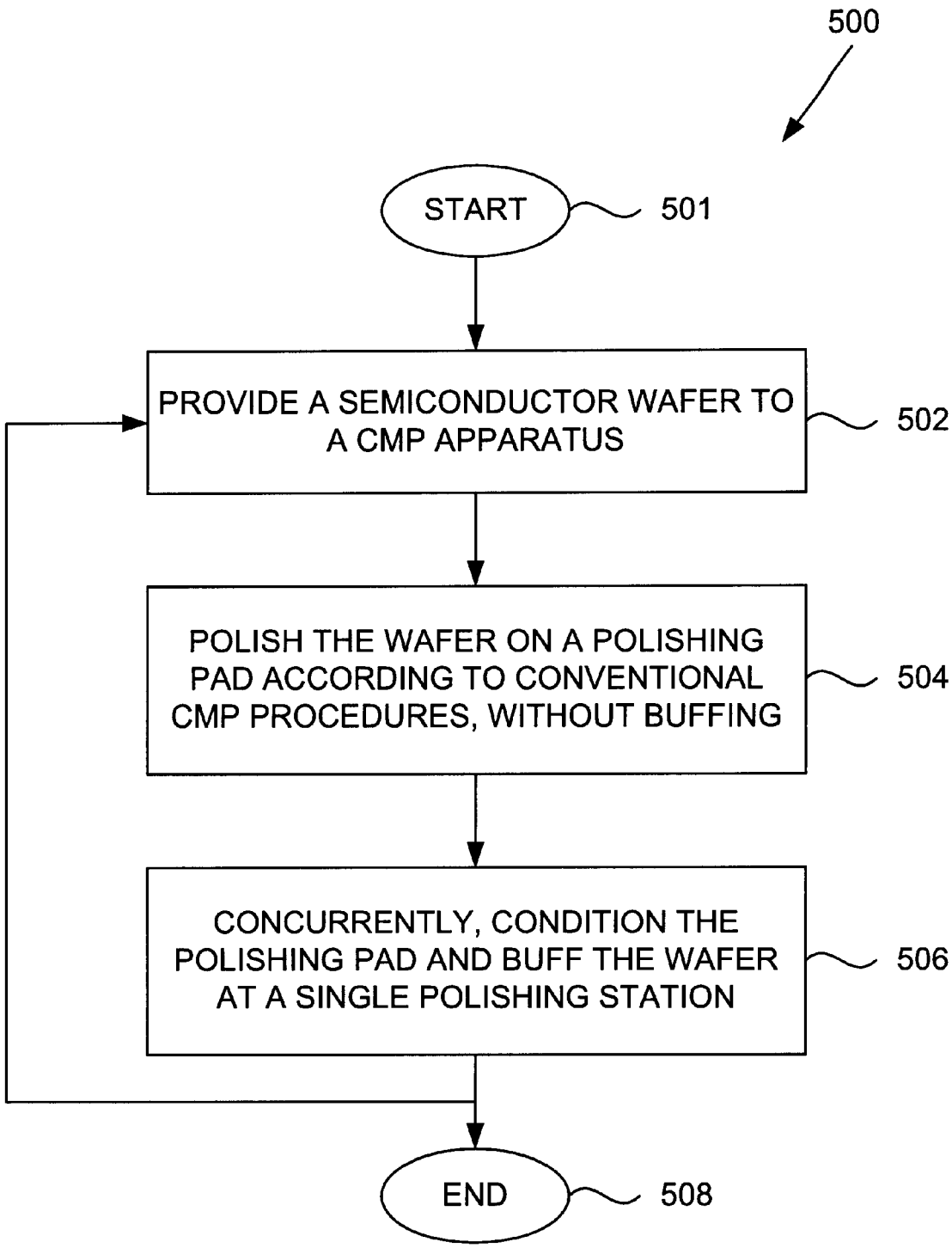
FIG. 5 depicts a flow chart illustrating a generalized process of concurrently pad conditioning and wafer buffing according to a preferred embodiment of the present invention.

FIG. 5 shows a flow chart depicting the steps of a generalized method of concurrently pad conditioning and wafer buffing in chemical mechanical polishing in accordance with a preferred embodiment of the present invention. The method 500 starts at 501 and at step 502 a semiconductor wafer is provided to CMP apparatus. Next, at step 504, the wafer is polished on a polishing pad according to conventional CMP procedures, without buffing. Then, at a step 506, the polishing pad is conditioned and the wafer is buffed concurrently at a single polishing station. Following step 506, the process may return to step 502 for the next wafer, or it may be completed at 508. Of course, as described below, processes according to the present invention may include further steps.

Figure 6:
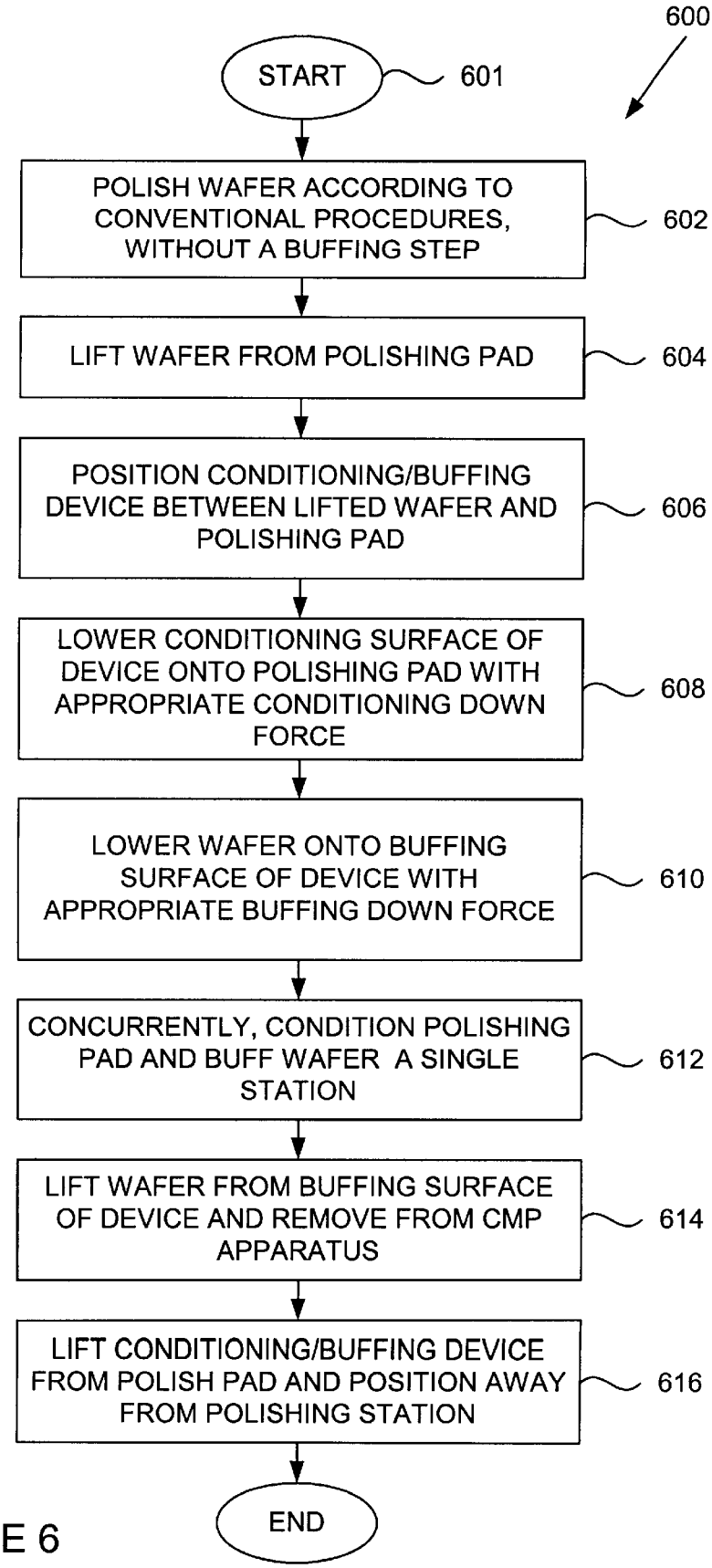
FIG. 6 depicts a flow chart illustrating a process of concurrently pad conditioning and wafer buffing using a device in accordance with a preferred embodiment of the present invention.

A device according to the present invention may be used following completion of conventional CMP, in accordance with the generalized method described above. In a preferred embodiment, illustrated by the process flow 600 starting at 601 in FIG. 6, a semiconductor wafer is polished according to conventional procedures well known in the art, as described, for example, in Joseph M. Steigerwald, et aL, *Chemical Mechanical Planarization of Microelectronic Materials*, John Wiley & Sons, New York (1997), at a step 602. Then, at a step 604, a polished wafer 432 from a station 422 of a CMP apparatus 420 is lifted from a polishing pad 414, typically by a wafer carrier 430. The conditioning/buffing device 400 of the present invention is then positioned between the lifted wafer 432 and the polishing pad 414 at a step 606.

At a step 608, the lower surface 406 of the conditioning/buffing device 400, which is equipped with the pad conditioner 410 is lowered onto the polishing pad 414 by the arm 416 with an appropriate amount of down force for the conditioning procedure, typically 2–5 psi. Before, during or after the pad conditioner 410 is contacted with the polishing pad 414, at a step 610 the wafer 432 is lowered onto the buffing pad 408 of the device 400, typically by a wafer carrier 430, with the appropriate down force for buffing operations. As noted steps 608 and 610 may also take place concurrently, or may be reversed within the scope of the present invention.

Then, at a step 612, the polishing pad 414 is conditioned as the wafer 432 is buffed. The device 400 and apparatus 420 act in concert to provide the appropriate differential velocity between the polishing pad 414 and pad conditioner 410 of the device 400, and the wafer 432 and the buffing pad 408 of the device 400. In particular, the chuck 424 may rotate and/or orbit the polishing pad 414, and the wafer carrier 430 may rotate and/or oscillate the wafer 432. The device 400 may maintain a stationary position during the conditioning/buffing operations, or, more preferably, it may oscillate (as in conventional pad conditioning) in order to increase the differential velocities and enhance the conditioning and buffing effects.

When conditioning and buffing are completed, the buffed wafer 432 is lifted, typically by the wafer carrier 430, from the buffing pad 408 and stored or removed from the CMP apparatus 420, at a step 614. This results in a cleaner finished product with lower defect density than in some conventional polishing and buffing techniques, where the finished wafer is typically returned to the polish pad before being removed from the CMP apparatus. Before, while, or after the wafer 432 is removed from the buffing pad 408, the device 400 is lifted from the polishing pad 410 by the arm 416, at a step 616. Then, the device 400 is positioned away from the polishing station 422 to provide access to the station 422 for another wafer (not shown). The process flow concludes at 618.

Conventional CMP apparatuses, such as the IPEC 676 and 776 may be adapted to integrate a conditioning/buffing device in accordance with the present invention. In a preferred embodiment, the device will be mounted so that it may service a plurality of polishing stations on the apparatus. However, the ratio of devices to stations should not be so low that a station is inoperative for an unacceptable period while waiting for a device to service another station. At current processing rates, it is believed that one conditioning/buffing device for every two polishing stations would be optimal. The invention is not so limited, however, and the optimal ratio may vary depending on process conditions and parameters. Moreover, since the invention allows all stations on a CMP apparatus to be dedicated to polishing, the number of different polishing operations (for instance, using different polishing pads and buffing pads) on a single CMP apparatus may be maximized.

Although the foregoing invention has been described in some detail for purposes of clarity of understanding, it will be apparent that certain changes and modifications may be practiced within the scope of the appended claims. For example, while the specification has described the structure of a particular device which accomplishes the objectives of the present invention, many others which will be understood by those of skill in the art from the present disclosure to be within the spirit of the present invention may equally be used. Therefore, the present embodiments are to be considered as illustrative and not restrictive, and the invention is not to be limited to the details given herein, but may be modified within the scope of the appended claims.

What is claimed is:

1. A device for concurrently pad conditioning and wafer buffing at a single station on a chemical mechanical polishing apparatus, comprising:

a positioning mechanism for positioning said device within said apparatus;

a body connected to a distal end of said positioning mechanism, said body having upper and lower surfaces;

a buffing pad on one of the upper and lower surfaces of said body; and a pad conditioner on the other of the upper and lower surfaces of said body.

2. The device of claim 1 further comprising at least one transport line for at least one of conditioning and buffing supplies.

3. The device of claim 1 wherein said positioning mechanism comprises an articulated arm assembly.

4. The device of claim 3 wherein said arm assembly is capable of providing a force to said body.

5. The device of claim 4 wherein said force is about 2 to 5 psi.

6. The device of claim 1 wherein said pad conditioner comprises a diamond grit.

7. The device of claim 1 wherein said pad conditioner comprises an abrasive pivotable arm.

8. The device of claim 1 wherein said pad conditioner comprises an abrasive rotatable disk.

9. The device of claim 1 wherein said buff pad comprises polyurethane impregnated felt.

10. A chemical mechanical polishing apparatus, comprising:

a wafer carrier;

one or more polishing pads, each polishing pad at a polishing station; and a device for concurrently pad conditioning and wafer buffing at a single station on said chemical mechanical polishing apparatus, said device having, a positioning mechanism for positioning said device within said apparatus;

a body connected to a distal end of said positioning mechanism, said body having upper and lower surfaces;

a buffing pad on the upper surface of said body; and a pad conditioner on the lower surface of said body.

11. The device of claim 10 wherein said apparatus comprises a plurality of said devices.

12. A chemical mechanical polishing apparatus module, comprising:

one or more polishing pads, each polishing pad at a polishing station; and a device for concurrently pad conditioning and wafer buffing at a single station on said chemical mechanical polishing apparatus module, said device having, a positioning mechanism for positioning said device relative to said apparatus module;

a body connected to a distal end of said positioning mechanism, said body having upper and lower surfaces;

a buffing pad on one of the upper and lower surfaces of said body; and a pad conditioner on the other of the upper and lower surfaces of said body.

13. A device for concurrently performing pad conditioning and a wafer polishing operation at a single station on a chemical mechanical polishing apparatus, comprising:

a positioning mechanism for positioning said device within said apparatus;

a body connected to a distal end of said positioning mechanism, said body having upper and lower surfaces;

a polishing pad on one of the upper or lower surfaces of said body; and a pad conditioner on the other surface of said body.

14. A means for concurrently pad conditioning and wafer buffing at a single station on a chemical mechanical polishing apparatus, comprising:

buffing means on a first side of a support means;

pad conditioning means on a second side of said support means; and means for positioning said support means between a semiconductor wafer and polishing pad at a polishing station, said support means and positioning means capable of concurrently pad conditioning and wafer buffing at said polishing station.

* * * * *